US005439352A

United States Patent [19]

Line

[11] Patent Number: 5,439,352

[45] Date of Patent: Aug. 8, 1995

[54] DECORATIVE CASING FOR A CEILING FAN

[76] Inventor: Chin Line, P.O. Box 82-144, Taipei, Taiwan

[21] Appl. No.: 24,241

[22] Filed: Mar. 1, 1993

[51] Int. Cl.[6] ..... F04D 29/62

[52] U.S. Cl. ..... 416/170 R; 416/5

[58] Field of Search ..... 416/5, 170 R; 403/397, 403/405.1; 310/89, 91

[56] References Cited

U.S. PATENT DOCUMENTS 5,151,011 9/1992 Rezek ..... 416/5

*Primary Examiner*—Edward K. Look

*Assistant Examiner*—Christopher M. Verdier

*Attorney, Agent, or Firm*—Alfred Lei

[57] ABSTRACT

This invention relates to a decorative casing for a ceiling fan having a body portion, characterized in that the decorative casing is provided with an upper edge curving inwards to form a rack and a bottom having a plurality of slots for dissipating heat evolved from a motor of the ceiling fan, the body portion having a top with a plurality of radial engaging mechanisms each of which includes two pairs of guides and a resilient supporting member having a raised portion at one end and a roller at another end, the roller of the resilient supporting member being engageable with the rack of the decorative casing.

5 Claims, 2 Drawing Sheets

DECORATIVE CASING FOR A CEILING FAN

BACKGROUND OF THE INVENTION

It is found that the prior art ceiling fan is a device for agitating air from one location to another so as to achieve cooling purposes. However, almost all components of the ceiling fan are made of metallic material thereby rendering the observer a cool feeling. Hence, there is a need for giving the ceiling fan a new life by means of beautiful patterns or the like.

Therefore, it is an object of the present invention to provide a decorative fan for a ceiling which may obviate and mitigate the above-mentioned drawbacks.

SUMMARY OF THE INVENTION

This invention relates to a decorative casing for a ceiling fan.

It the primary object of the present invention to provide a decorative casing which may be conveniently connected with a ceiling fan.

It is another object of the present invention to provide a decorative casing for a ceiling fan which is resistant to wear.

It is still another object of the present invention to provide a decorative casing for a ceiling fan which may be printed with desired patterns.

It is still another object of the present invention to provide a decorative casing for a ceiling fan which is economical to produce.

It is a further object of the present invention to provide a decorative casing for a ceiling fan which is low in cost.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
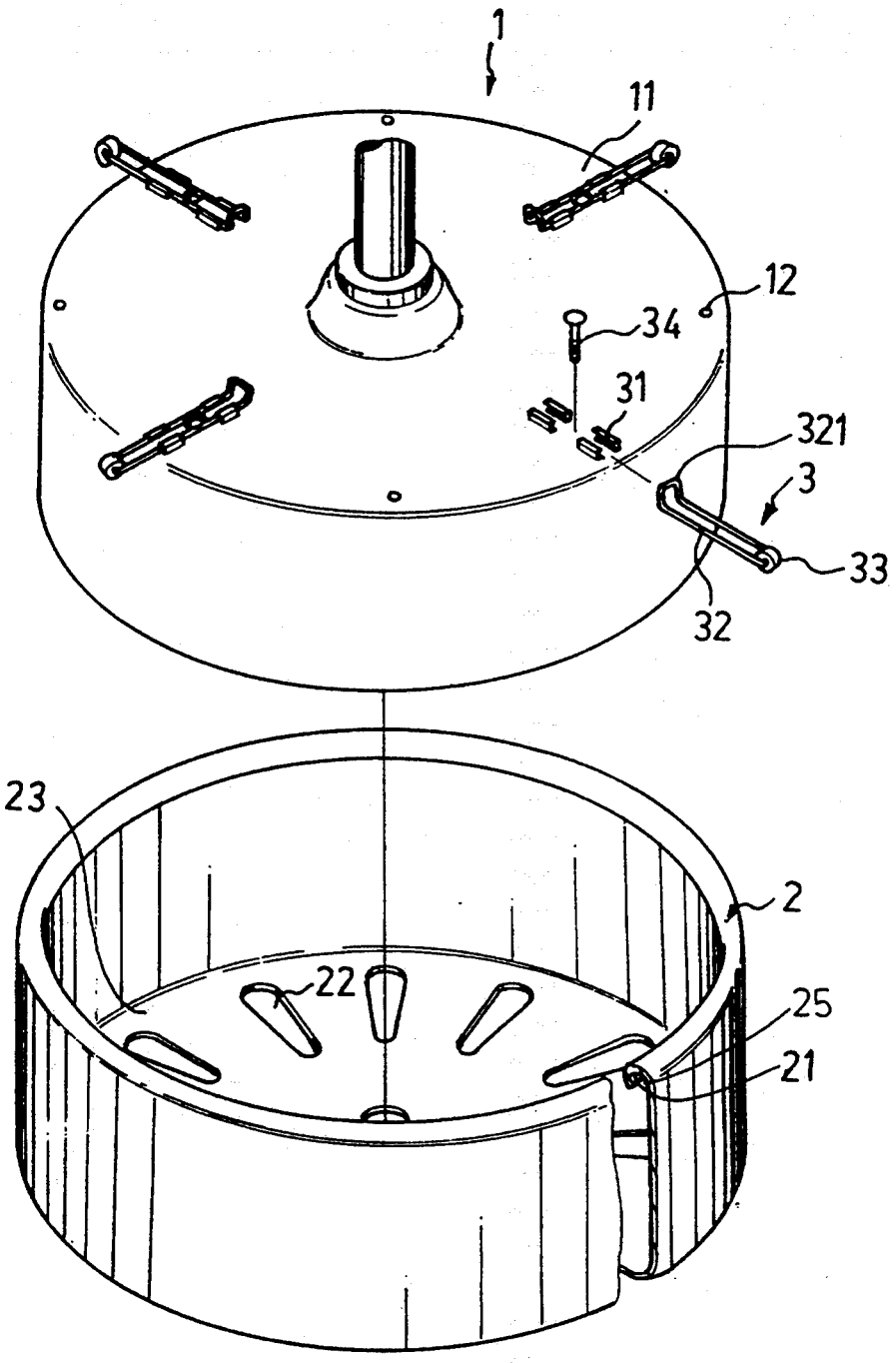
FIG. 1 is an exploded view of the present invention.
Figure 2:
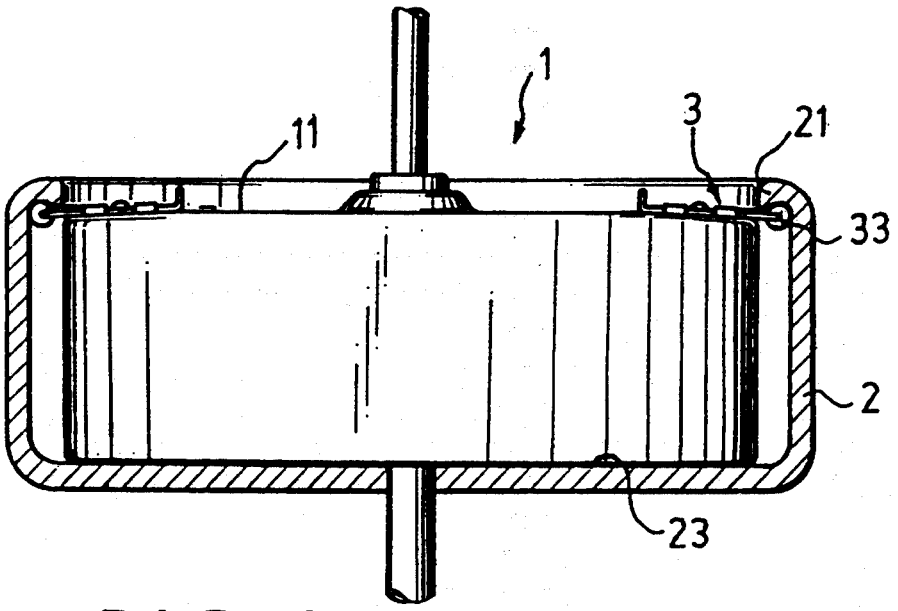
FIG. 2 is a sectional view of the present invention.
Figure 3:
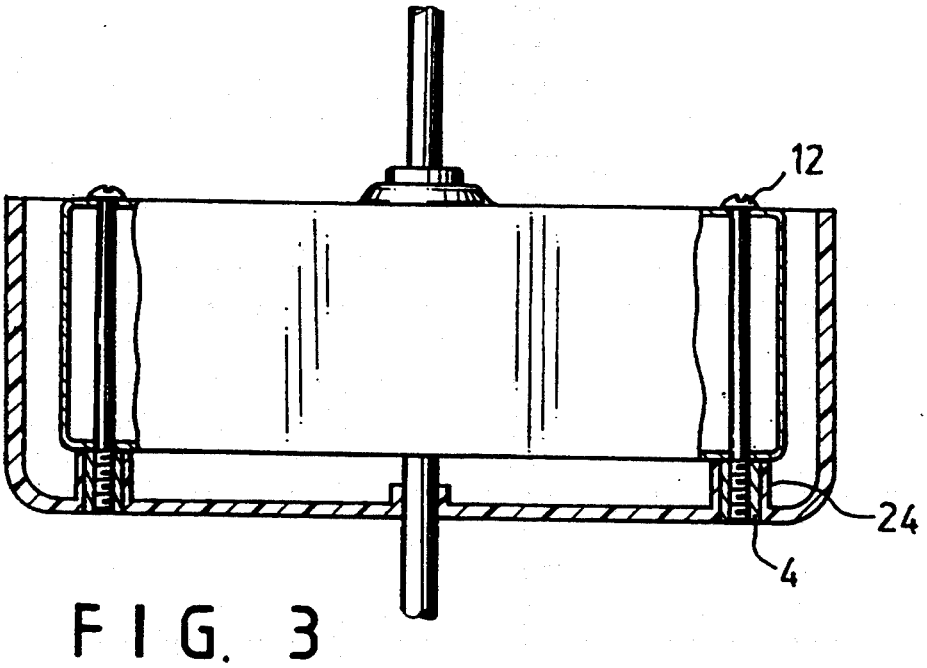
FIG. 3 is a sectional view of another preferred embodiment of the present invention.

With reference to the drawings and in particular to FIG. 1 thereof, the present invention mainly comprises a body portion 1 and a decorative casing 2. The body portion 1 is a cylindrical member adapted to fit into the decorative casing 2. The decorative casing 2 may be made of potter's clay, porcelain clay, or the like and has special patterns thereon. The upper edge 21 of the decorative casing 2 is curved inwards to form a rack 25. Further, the bottom 23 of the decorative casing 2 is formed with a plurality of slots 22 for dissipating heat evolved from the motor of the ceiling fan (not shown).

On the top 11 of the body portion 1 there are a plurality of radial engaging mechanisms each of which includes two pairs of guides 31 and a resilient supporting member 32 slidably engaged with the guides 31. The resilient supporting member 32 is provided with a raised portion 321 at one end and a roller 33 at the other. Further, the resilient supporting member 32 may be kept in tight connection with the guides 31 by a screw 34.

In assembly, simply push the resilient supporting member outwards so as to engage the roller 33 with the rack 25 of the decorative casing 2. Then the resilient supporting member 32 is kept in a fixed position by the screw 34. In addition, the weight of the body portion 1 is evenly supported by the bottom 23 of the decorative casing 2 so that the motor of the ceiling fan may be kept running at a steady condition.

It should be noted that the decorative casing 2 may be simply made of plastic injection molding and printed any desired patterns, figures, or the like. Besides, the bottom 23 of the decorative casing 2 is provided with a plurality of tubular protuberances 24 in which is inserted a metallic threaded ferrule 4 for engaging with a screw 12.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A decorative casing for a ceiling fan having a body portion, characterized in that said decorative casing is provided with an upper edge curving inwards to form a rack and a bottom having a plurality of slots for dissipating heat evolved from a motor of said ceiling fan, said body portion having a top with a plurality of radial engaging mechanisms each of which includes two pairs of guides and a resilient supporting member having a raised portion at one end and a roller at another end, the roller of said resilient supporting member being engageable with the rack of said decorative casing.

2. The decorative casing for a ceiling fan as claimed in claim 1, wherein said resilient supporting member is fixed in position by a screw.

3. The decorative casing for a ceiling fan as claimed in claim 1, wherein said decorative casing is made of potter's clay.

4. The decorative casing for a ceiling fan as claimed in claim 1, wherein said decorative casing is made of porcelain clay.

5. The decorative casing for a ceiling fan as claimed in claim 1, wherein said decorative casing is made of plastic.

* * * * *